US007147823B2

(12) United States Patent
Loewen

(10) Patent No.: US 7,147,823 B2
(45) Date of Patent: Dec. 12, 2006

(54) HIGH TEMPERATURE COOLING SYSTEM AND METHOD

(75) Inventor: Eric P. Loewen, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 675 days.

(21) Appl. No.: 10/123,391

(22) Filed: Apr. 15, 2002

(65) Prior Publication Data

US 2003/0194345 A1 Oct. 16, 2003

(51) Int. Cl.
*C23F 11/08* (2006.01)

(52) U.S. Cl. ..... 422/7; 376/306; 976/DIG. 201; 976/DIG. 217

(58) Field of Classification Search ..... 422/3, 422/7, 8, 9, 19, 62; 376/306; 976/DIG. 201
See application file for complete search history.

(56) References Cited

U.S. PATENT DOCUMENTS

| | | | | | |
|---|---|---|---|---|---|
| 1,934,083 | A | * | 11/1933 | Moll et al. | 75/499 |
| 3,606,986 | A | * | 9/1971 | Greenberg | 266/240 |
| 3,642,603 | A | | 2/1972 | Sakai et al. | |
| 3,876,527 | A | | 4/1975 | Dugan et al. | |
| 3,983,303 | A | | 9/1976 | Biermann et al. | |
| 3,999,602 | A | | 12/1976 | Fewell et al. | |
| 4,168,333 | A | | 9/1979 | Rausch et al. | |
| 4,242,420 | A | | 12/1980 | Rausch et al. | |
| 4,344,911 | A | | 8/1982 | Maniscalco et al. | |
| 4,456,231 | A | * | 6/1984 | Bergsoe | 266/215 |
| 4,600,554 | A | | 7/1986 | Brachet et al. | |
| 4,686,081 | A | * | 8/1987 | Takashima et al. | 420/29 |
| 4,909,839 | A | | 3/1990 | Hollis | |
| 5,026,517 | A | | 6/1991 | Menken et al. | |
| 5,059,383 | A | | 10/1991 | Modarres | |
| 5,202,100 | A | | 4/1993 | Nagel et al. | |
| 5,246,484 | A | * | 9/1993 | Deininger | 75/585 |
| 5,461,185 | A | | 10/1995 | Forsberg et al. | |
| 5,935,519 | A | * | 8/1999 | Benner et al. | 422/52 |

OTHER PUBLICATIONS

Lupu et al. CAPLUS abstract No. 1962:428632 of "The possibility of using methane as a reducing agent in the metallury of lead. III. Reduction of PbO with methane." Acad. Rep. Populare Romine, Studii Cercetari Met. vol. 6 (1961), pp. 451-475.*

Adamov, E., et al., "Nuclear power at the next stage: cost-effective breeding, natural safety, radwastes, non-proliferation," *Nuclear Engineering and Design*, vol. 173, pp. 33-41 (1997).

Bannister, M., "The standard molar Gibbs free energy of formation of PbO Oxygen concentration-cell measurements at low temperatures," *J. Chem. Thermodynamics*, vol. 16, pp. 787-792 (1984).

Barak, A., et al., "Possibilities For Improvements In Liquid-Metal Reactors Using Liquid-Metal Magnetohydrodynamic Energy Conversion," *Nuclear Technology*, vol. 89, pp. 36-51 (Jan. 1990).

Barbier, F., et al., "Compatibility tests of steels in flowing liquid lead—bismuth," *Journal of Nuclear Materials*, vol. 295, pp. 149-156 (Jun. 2001).

Brasunas, A., "Interim Report on Static Liquid-Metal Corrosion," Oak Ridge National Laboratory, Doc. No. 1647, pp. 1-90 (May 11, 1954).

Cathcart, J., "Mass Transfer In Dynamic Lead-Inconel Systems,"Oak Ridge National Laboratory, Doc. No. 52-11-116, pp. 1-8 (Nov. 14, 1952).

Cathcart, J., et al., "A Technique For Corrosion Testing In Liquid Lead," Oak Ridge National Laboratory, Doc. No. 44960, pp. 1-5 (Aug. 19, 1954).

Everhart, J., et al., "Liquid Metal Heat Transfer Fluid Unstressed Static Corrosion Tests," American Smelting & Refining Company, Research Department, Report No. N-3, pp. 1-15 (Mar. 20, 1950).

Gromov, B., et al., "Inherently Safe Lead—Bismuth—Cooled Reactors," *Atomic Energy*, vol. 76(4), pp. 323-330 (1994).

Knebel J., et al., "Gas-Phase Oxygen Control Processes For Lead/Bismuth Loops And Accelerator Driven Systems," *Jahrestagung Kerntechnik*, pp. 645-649 (1999).

Knebel, J., et al., "Research On Transmutation And Accelarator-Driven Systems At The Forschungszentrum Karlsruhe," *Internationale Zeitschrift für Kernenergie atw Jg.*, Heft 6, pp. 350-358 (Jun. 2000).

Kuznetsov, V., et al., "Radioactive Waste Transmutation and Safety Potentials of the Lead Cooled Fast Reactor in the Equilibrium State," *Journal of Nuclear Science and Technology*, vol. 32 (6), pp. 507-516 (Jun. 1995).

Lefhalm, C., et al., "Kinetics of gas phase oxygen control system (OSC) for stagnant and flowing Pb-Bi Systems," *Journal of Nuclear Materials*, vol. 296, pp. 301-304 (Jul. 2001).

Li, N., "Active control of oxygen in molten lead-bismuth eutectic systems to prevent steel corrosion and coolant contamination", *Journal of Nuclear Materials*, vol. 300 pp. 73-81 (Jan. 2002).

(Continued)

*Primary Examiner*—William H. Beisner
(74) *Attorney, Agent, or Firm*—Klaas Lau

(57) ABSTRACT

A method for cooling a heat source, a method for preventing chemical interaction between a vessel and a cooling composition therein, and a cooling system. The method for cooling employs a containment vessel with an oxidizable interior wall. The interior wall is oxidized to form an oxide barrier layer thereon, the cooling composition is monitored for excess oxidizing agent, and a reducing agent is provided to eliminate excess oxidation. The method for preventing chemical interaction between a vessel and a cooling composition involves introducing a sufficient quantity of a reactant which is reactive with the vessel in order to produce a barrier layer therein that is non-reactive with the cooling composition. The cooling system includes a containment vessel with oxidizing agent and reducing agent delivery conveyances and a monitor of oxidation and reduction states so that proper maintenance of a vessel wall oxidation layer occurs.

2 Claims, 4 Drawing Sheets

OTHER PUBLICATIONS

Risold, D., et al., "The Bismuth-Oxygen System," *Journal of Phase Equilibria*, vol. 16(3), pp. 223-234 (1995).

Romano, A., et al., "The Investigation of Container Materials for Bi and Pb Alloys Part I. Thermal Convection Loops," Brookhaven National Laboratory, Upton, NY, BNL 811 (T-313) Metals, Ceramics, and Materials,—TID-4500, 20th ed., pp. 1-24 (Jul. 1963).

Szwarc, R., et al., "The Diffusivity and Solubility of Oxygen in Liquid Lead from Electrochemical Measurements," *High Temperature Science*, vol. 4, pp. 347-356 (1972).

Weeks, J.R., "Lead, Bismuth, Tin and Their Alloys as Nuclear Coolants," *Nuclear Engineering and Design*, 15, pp. 363-372 (1971).

Clifford, J., "A Loop for Circulating Liquid Lead-Bismuth Mixtures: Corrosion Studies and Operation", Dissertation, Iowa State University of Science and Technology, Ames, Iowa, 1960.

* cited by examiner

HIGH TEMPERATURE COOLING SYSTEM AND METHOD

CONTRACTUAL ORIGIN OF THE INVENTION

This invention was made with United States Government support under contract number DE-AC07-99ID13727, awarded by the United States Department of Energy. The United States Government has certain rights to the invention.

BACKGROUND OF THE INVENTION

The present invention relates in general to a method and related apparatus for cooling a heat source, and in particular to a method which employs a circulating liquid metal coolant composition as a heat dissipation medium within a closed-loop containment vessel of a cooling system. The interior surface of the vessel is covered with a protective coating such as an oxide layer to prevent an untoward reaction between the vessel and the liquid metal composition.

Traditional heat sources that require proactive heat removal include process systems such as those exemplified by internal-combustion engines, gasoline-driven and coal-driven electricity generators, nuclear reactors, accelerator-driven radioactive waste transmutators, spalation sources used in nuclear accelerators, and the like. Efficient cooling systems have been developed that utilize liquid metal compositions as heat absorbers, and such liquid metal systems are usually found in association with nuclear reactors and related equipment that generate significant heat during operation. The desirability of liquid metal compositions for heat removal is attributed to liquid metal properties that include high thermal conductivity, thermal stability, low neutron capture cross section (resulting in relatively uniform power distributions), self shielding from reactor gamma-rays, high boiling points (enabling in low-pressure operation at high temperatures), and high capacities for heat absorption, storage, and dissipation.

Liquid metal cooling systems operate in much the same manner as do the aqueous-coolant cooling systems for conventional internal combustion engines found in vehicles. Thus, in conventional liquid metal cooling systems, the liquid metal is confined in a closed-loop system which includes a heat source portion and a heat exchanger portion. Operationally, the heat source portion comes into thermal communication with a heat source (e.g. a nuclear reactor) and heat therefrom transfers into the liquid metal composition as it travels through the heat source portion of the closed-loop. As a result, the temperature of the liquid metal composition increases as the composition passes through the heat source portion. After absorption of heat, the liquid metal composition continues its travel within the closed-loop for ultimate arrival at the heat exchanger portion where the absorbed heat is dissipated and the composition continues in the closed-loop for return to the heat source portion as the circuit repeats.

The closed-loop containment vessel described above is generally constructed from an alloy pipe, with steel usually being the material of choice because of its physical properties which primarily include compatibility with high heat coupled with favorable economic considerations. Beyond these considerations, however, is the need for compatibility between the containment vessel and the liquid metal composition therein. In this regard, and unfortunately, molten sodium, lithium, lead, bismuth and their respective alloys readily corrode steel and steel alloys. As is generally recognized, corrosion is the process by which a molten metal cooling composition destroys another metal (such as the containment vessel of a closed-loop system) and, for this reason, the suitability of many metals for cooling purposes is severely limited.

Lead and lead alloys are of particular interest in liquid metal cooling systems. While lead and lead alloys in liquid metal cooling systems offer several advantages, lead compositions are particularly aggressive to most metal components in these systems. The aggressive nature of liquid lead compositions has resulted in trial systems manufactured from exotic materials supposedly immune to attack, but which experimentally show that lead-based problems continue to exist. Likewise, prior approaches for solving lead incompatibility have included the provision of additives and inhibitors, diffusion coatings, and plasma deposition. Thus, additives and inhibitors such as uranium, magnesium, zirconium, titanium, tellurium, thorium, calcium, chromium, and tungsten were studied for corrosion control properties, with reductions in corrosion rates being accomplished by zirconium, tungsten, and chromium. Regarding the application of diffusion coatings, U.S. Pat. No. 4,242,420 to Rausch et al. teaches application of a diffusion coating on a ferrous substrate by introducing a molten alloy bath basically consisting of lead and chromium to thereby coat chromium on iron. The resulting coating, however, was rough and porous. Finally, plasma deposition of molybdenum, zirconium, or carbide salts on the surface of a metal has been performed to provide a protective layer. However, all of the above-described methods of corrosion control suffer from erratic adherence of the protective coating and non-uniformity of the protective layer, conditions that are unacceptable in many applications.

Another approach that has been employed for the inhibition of corrosion is the provision of an oxide layer on the affected surface. Such oxide layers can be produced by oxygen-bearing gases introduced into the molten metal cooling composition, but the quantity of oxygen, and therefore oxidation, is critical to controlling the formation of the oxide layer. Conventional methods for monitoring oxygen levels in molten metal cooling compositions use zirconia probes originally developed for the measurement of oxygen in liquid-sodium cooling systems. Reliability of these zirconia probes in a molten metal cooling composition (especially lead) is known to be problematic and thus can result in the continuous formation of an oxide layer which will eventually shut down the flow path for coolant. Furthermore, because prior techniques do not provide for the reversal of excess oxidation, such coolant flow shutdown can cause catastrophic equipment damage.

BRIEF SUMMARY OF THE INVENTION

The present invention involves a method for cooling a heat source, a method for preventing chemical interaction between a containment vessel and a liquid composition housed therein, and a cooling system employing the inventive methods discussed herein. The method for cooling a heat source first provides a cooling system in thermal association with the heat source. This cooling system comprises a closed-loop, thermally-conductive containment vessel with an oxidizable interior wall forming a hollow interior which comprises a liquid metal coolant composition circulating through the interior. The containment vessel comprises a first portion positioned in thermal communication with the heat source for the acceptance of heat, and a second portion positioned in thermal communication with a heat exchanger for the dissipation of heat. A sufficient quantity of an oxidizing agent is introduced into the coolant composition for oxidizing the interior wall of the containment vessel and forming an oxide barrier layer on the interior wall. The oxide barrier layer protects the interior wall from reacting with the coolant composition. Finally, the coolant composition is monitored in order to detect an excess amount of oxidizing agent. If excess oxidizing agent is detected, a reducing agent is supplied to the coolant composition for reducing oxidation without interrupting the operation of the cooling system.

The inventive cooling system discussed herein comprises a closed-loop at least a portion thereof being a thermally-conductive containment vessel with an oxidizable interior wall forming a hollow interior for housing a coolant composition circulatable through the interior. The containment vessel comprises a first portion positionable in thermal communication with the heat source for the acceptance of heat, and a second portion positionable in thermal communication with a heat exchanger for the dissipation of heat. An oxidizing agent delivery conveyance is in communication with the interior of the containment vessel for delivering an oxidizing agent thereto, while a reducing agent delivery conveyance is likewise in communication with the interior of the containment vessel for delivering a reducing agent thereto. Finally, the system includes a monitor for monitoring (e.g. analyzing) and reporting oxidation and reduction states which exist within the interior of the containment vessel so that oxidizing or reducing agents can be introduced in order to maintain a correct oxidative state within the interior during operation.

BRIEF DESCRIPTION OF THE DRAWING

An illustrative and presently preferred embodiment of the invention is shown in the accompanying drawing in which.

DETAILED DESCRIPTION OF THE INVENTION

Figure 1:
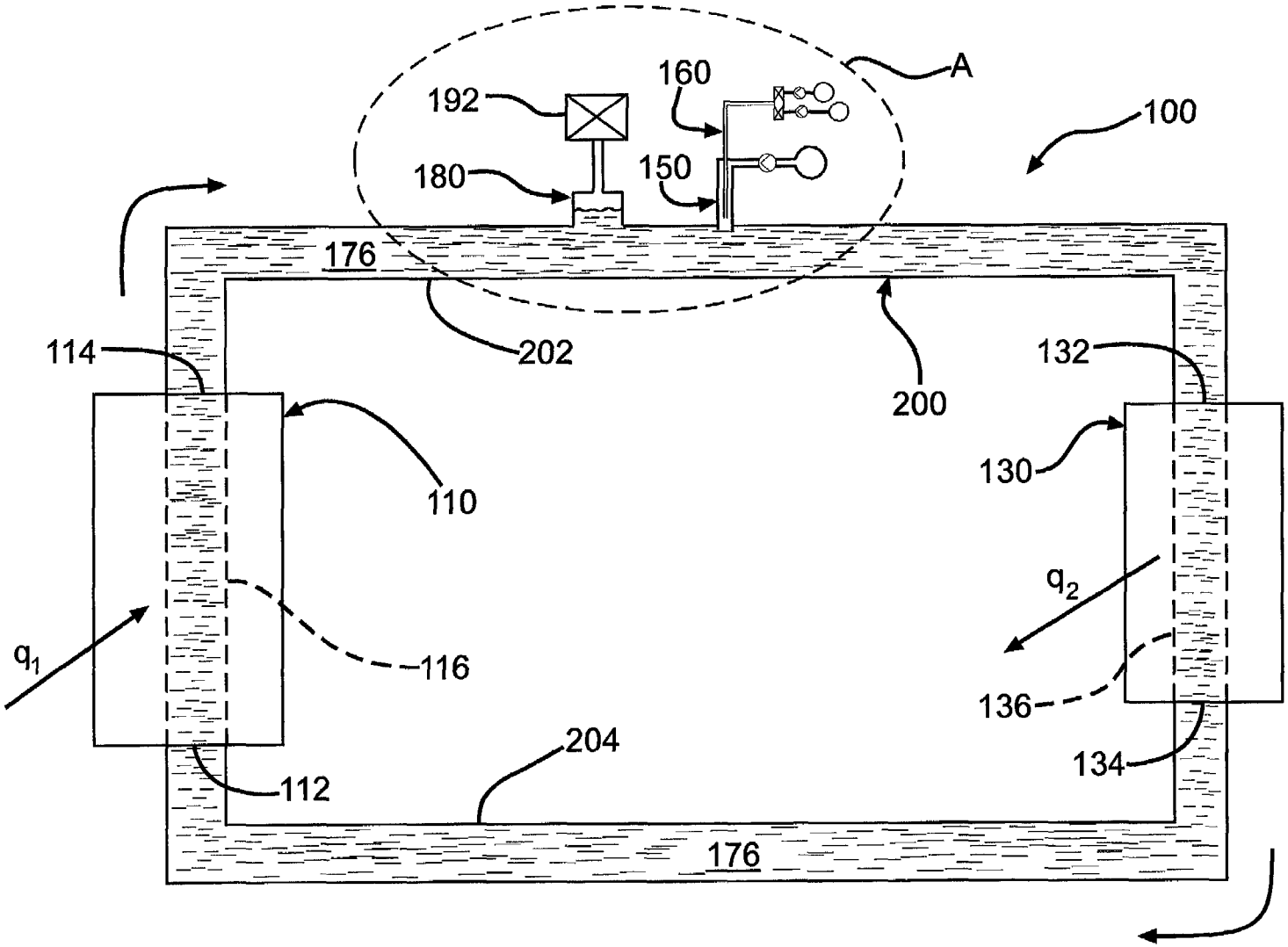
FIG. 1 is a schematic representation of a liquid metal cooling system provided with an oxide layer management system.

Referring to FIG. 1, a cooling system 100 with an oxide layer deposition system is illustrated for preventing chemical interaction between a molten metal cooling composition 176 and the system 100. As shown, the cooling system 100 is a liquid metal cooling system for cooling a heat source (e.g. a process system 110). The cooling system 100 is provided with a containment vessel in the form of, for example, a containment pipe 200, a heat exchanger 130, a tuyere tube 150, a gas/molten-metal separator 180, and a molten metal cooling composition 176. The details of each of the aforementioned exemplary components will now be detailed herein.

The heat producing process system 110 is provided with a process system inlet 112, a process system outlet 114, and a heat-exchanging surface 116. The heat-exchanging surface 116 is located between the process system inlet 112 and the process system outlet 114. The heat-exchanging surface 116 is provided for transferring heat "$q_1$" from the process system 110 into the molten metal cooling composition 176 via thermal communication therewith. One non-limiting example of the heat exchanging surface 116 is a flow path or tubular conduit wrapped circumferentially around a cylindrical reaction chamber, although any one of a variety of heat exchanging devices may be employed as those skilled in the art may appreciate upon reading the present disclosure. The process system 110 can involve a variety of different systems that produce heat (e.g. nuclear reactors, accelerator driven radioactive waste transmutators, spalation sources used in accelerators, and other comparable devices). The process system 110 generates heat as a product of the process (e.g. nuclear reaction, burning, resistance, or the like). The heat produced by the process system 110 typically needs to be removed in order to ensure optimized performance, to minimize failure, or to produce power (e.g. steam for a nuclear power plant).

The heat exchanger 130 is provided with a heat exchanger inlet 132, a heat exchanger outlet 134, and a heat-exchanging surface 136. The heat-exchanging surface 136 is located between the heat exchanger inlet 132 and the heat exchanger outlet 134. The heat exchanging surface 136 is used to remove heat "$q_2$" from the molten metal cooling composition 176 traveling through the heat exchanger 130 via thermal communication therewith. The heat exchanger 130 can involve a variety of conventional heat exchanging systems including but not limited to liquid baths, convection cooling fins, evaporative cooling towers, refrigeration devices, or the like.

Figure 2:
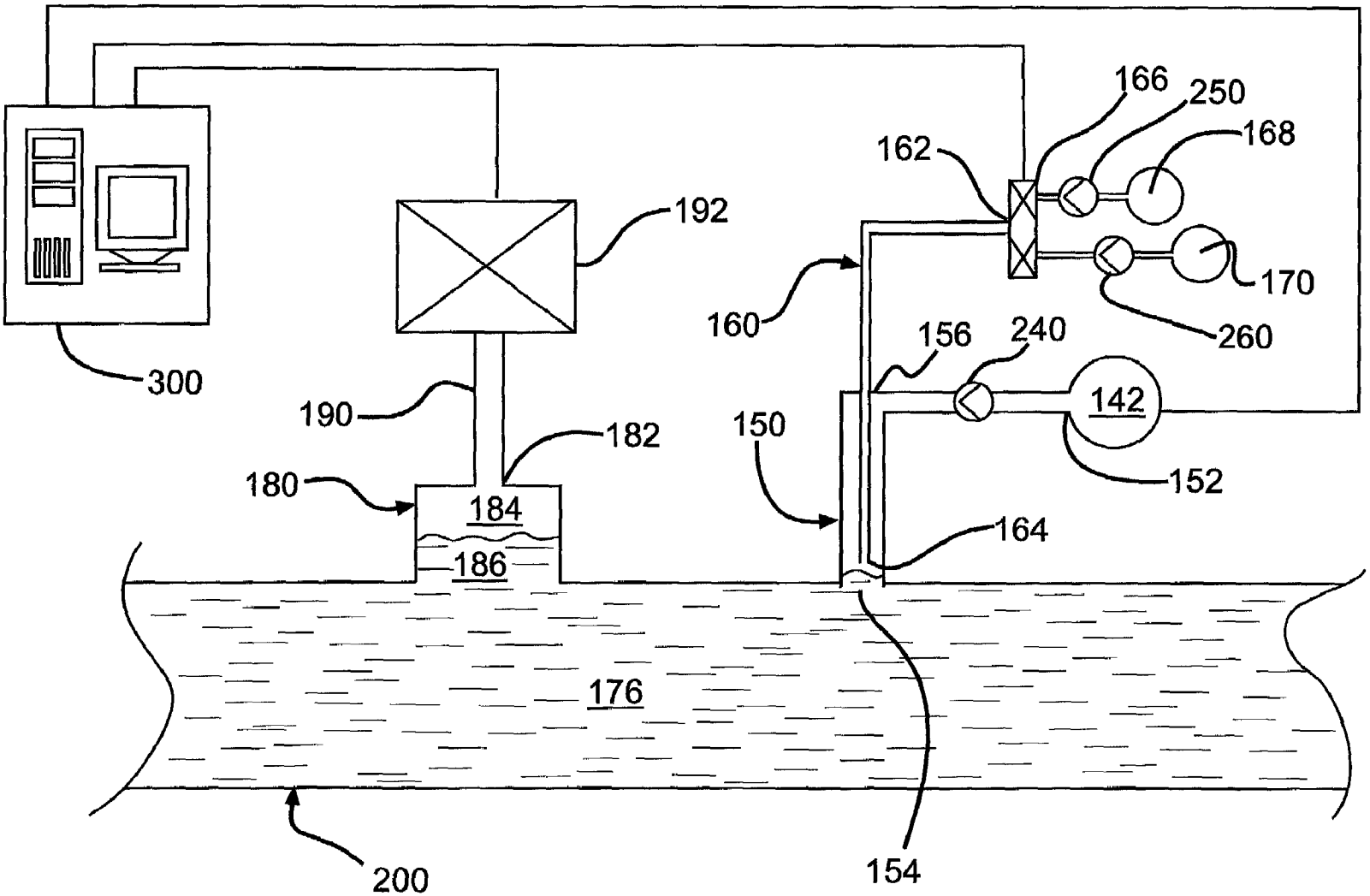
FIG. 2 is a schematic representation of the oxide layer management system of FIG. 1.

With reference to FIG. 2, an enlarged view of Section "A" of FIG. 1 is provided which shows the tuyere tube 150. The tuyere tube 150 includes an inlet portion 152, an outlet portion 154, and a portal (e.g. intermediate) portion 156. The tuyere tube 150 extends from the inlet portion 152 attached to a shroud gas source 142 (e.g., nitrogen, argon, helium, mixtures thereof, or their equivalents) into the outlet portion 154 located in the flow path of the molten metal cooling composition 176. The shroud gas (also characterized herein as a "mixing gas") is a substantially inert gas provided for reasons that will be detailed herein. In a non-limiting embodiment, the tuyere tube 150 is constructed of stainless steel, although the tuyere tube 150 may be made from any one of a variety of materials since it does not typically contact the molten metal cooling composition 176 and is therefore not vulnerable to corrosion by the cooling composition 176.

An oxidizing/reducing tube 160 is also provided which includes an inlet 162 and an outlet 164. The oxidizing/reducing tube 160 is a component of the tuyere tube 150 configured so that the oxidizing/reducing tube 160 extends from a valve 166 located at the inlet 162 to the outlet 164 located inside the tuyere tube 150. The oxidizing/reducing tube 160 passes through the tuyere tube 150 at the portal portion 156. The valve 166 is connected to an oxidizing agent source 168 (e.g. oxygen, carbon dioxide, mixtures thereof, or their equivalents) and/or a reducing agent source 170 (e.g. carbon, acetone, hydrogen, mixtures thereof, or their equivalents). The valve 166 is preferably a two-way valve having one outlet and a choice of at least two inputs (e.g. the oxidizing agent source 168 and the reducing agent source 170). Additionally, the valve 166 is preferably controllable so that neither agent is being supplied to the oxidizing/reducing tube 160.

A gas/molten-metal separator 180 is provided with an outlet fitting 182, a gas zone 184, and a liquid metal zone 186. The outlet fitting 182 is attached to a sampling tube 190. The sampling tube 190 is operatively connected to a gas analyzer 192 for analyzing gases located in the gas zone 184. Suitable gas analyzers include mass spectrometers, $CO/CO_2$ monitors, residual gas analyzers, gas chromatographs, or their equivalents. The gas zone 184 of the gas/molten-metal separator 180 is pressurized with a cover gas to prevent filling of the zone 184 with the molten metal cooling composition 176. The cover gas is any inert gas such as nitrogen, argon, helium, mixtures thereof, or their equivalents.

With reference to FIG. 1, the containment pipe 200 is provided as a path through which the molten metal cooling composition 176 travels between the process system 110 and the heat exchanger 130. The containment pipe 200 includes a first portion 202 and a second portion 204. In a non-limiting embodiment, the containment pipe 200 has a circular cross-sectional profile and is constructed of a ferrous-containing material (e.g. steel). The containment pipe 200 can be a pure metal substantially free of impurities or it can be an alloyed metal. Particular alloys of steel have been contemplated for this purpose including ferritic stainless steel (such as alloy-410) and austenitic stainless steel (such as alloy-316 and alloy-310). The first portion 202 of the containment pipe 200 is attached to the process system 110 at the process system outlet 114 and to the heat exchanger 130 at the heat exchanger inlet 132. The second portion 204 of the containment pipe 200 is attached to the heat exchanger 130 at the heat exchanger outlet 134 and to the process system 110 at the process system inlet 112. The flow of the molten metal cooling composition 176 therefore occurs in a closed-loop whereby molten metal cooling composition 176 exiting the process system outlet 114 travels through the containment pipe first portion 202, into the heat exchanger 130 where it comes in thermal communication with the heat-exchanging surface 136, and through the containment pipe second portion 204. Thereafter, the molten metal cooling composition 176 enters the process system 110 where it comes in thermal communication with the heat-exchanging surface 116 and then travels back to the process system outlet 114.

The tuyere tube 150 is attached to the containment pipe 200. The gas/molten-metal separator 180 is also attached to the containment pipe 200. In a non-limiting and representative embodiment, the gas/molten-metal separator 180 is located at the highest point in the circulation path. With the gas/molten-metal separator 180 at this position, contaminants (e.g. freely floating oxides) in the molten metal cooling composition 176 float to the surface located at the interface between the gas zone 184 and the liquid metal zone 186 (FIG. 2). Additionally, the flow of molten metal cooling composition 176 can be accomplished using a pump (not shown) or by thermally induced flow (also referred to as convective flow). The pump can be an electromagnetic pump or a centrifugal pump of standard design. To achieve thermally induced flow, the process system 110 is located at a lower level than the heat exchanger 130 so that heated molten metal cooling composition 176 flows upward from the process system 110 and cooled molten metal cooling composition 176 flows downward from the heat exchanger 130.

For descriptive purposes only, the molten metal cooling composition 176 described herein will involve an alloy of lead, more particularly a lead-bismuth alloy. However, it should be apparent to those skilled in the art that other metals may be used in the claimed invention including but not limited to sodium, lithium, lead, bismuth and alloys thereof in any proportion. Molten lead is a material that readily corrodes most other metals. In particular, steels and steel alloys comprising nickel are especially vulnerable to corrosion by molten lead. Since containment pipes and various components of cooling systems are operating at high temperatures, iron and/or steel alloys are often used. Therefore, it is of primary importance to minimize the corrosion of steel by molten lead.

In order to reduce the adverse effects caused by the corrosive nature of molten metal cooling compositions (in particular lead), the present apparatus and process have been developed. In accordance with the claimed apparatus and process, a protective oxide layer is deposited on the surfaces with which the molten metal cooling composition would otherwise come into contact. The oxide layer serves as a barrier coating through which the molten metal cooling composition cannot readily penetrate. As a result, the oxide layer protects containment pipes, process systems, heat exchangers, valves, fittings, and other components of the cooling systems under consideration.

Detailed information regarding the formation and reduction of metal oxides will now be provided. The formation of oxides occurs by introducing an oxidizing agent into the system. Oxidizing agents can include oxygen gas, carbon dioxide gas, mixtures thereof, or other gaseous compositions from which oxygen evolves. The following chemical reactions involve a combination of oxygen gas with various metals to produce metal oxides:

$$\tfrac{4}{5}Nb+O_2(g)=\tfrac{2}{5}Nb_2O_5 \quad (1)$$

$$\tfrac{4}{5}V+O_2(g)=\tfrac{2}{5}V_2O_5 \quad (2)$$

$$\tfrac{4}{3}Cr+O_2(g)=\tfrac{2}{3}Cr_2O_3 \quad (3)$$

$$2Fe+O_2(g)=2FeO \quad (4)$$

$$2Pb+O_2(g)=2PbO \quad (5)$$

$$2Bi+O_2(g)=2BiO \quad (6)$$

Figure 3:
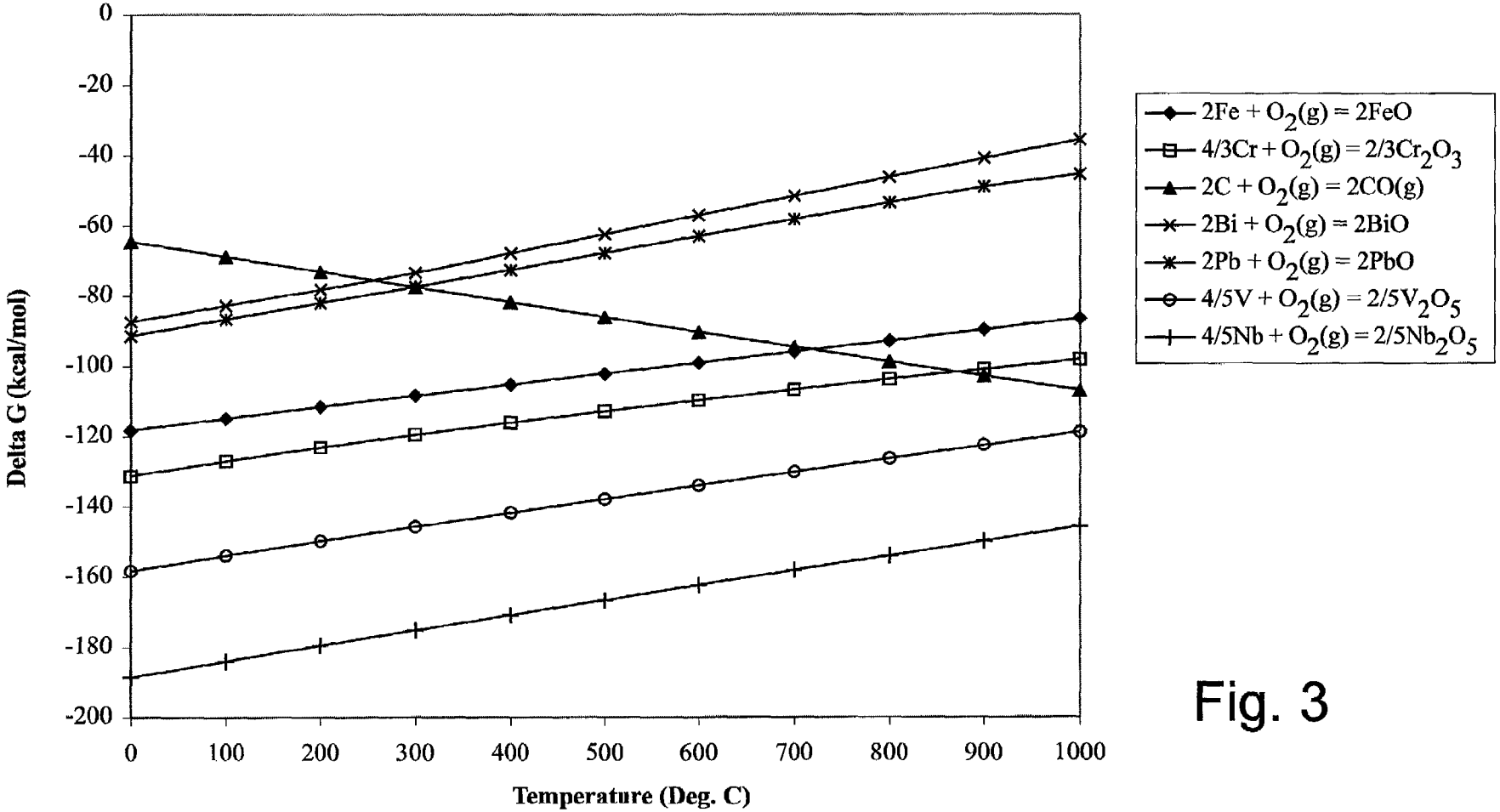
FIG. 3 is a chart of the free energy of formation of exemplary oxidizing reactions as a function of temperature.

The oxidation of various metals is presented in FIG. 3. In particular, FIG. 3 graphically illustrates the free energies of oxidation for iron, lead, bismuth, chromium, vanadium, and niobium versus temperature of operation for the cooling system of FIG. 1. Chromium and iron are of particular relevance because they are the primary components of stainless steel (in which chromium is at least about 11% by weight). As can be seen in FIG. 3, in the event that oxygen gas is introduced to a system having iron, lead, bismuth, chromium, vanadium, and niobium (as illustrated in equations 1–6, above), the reaction that is most likely to occur results in the formation of niobium oxide, equation 1. The second most likely reaction is vanadium with oxygen to form vanadium oxide, equation 2. The third most likely reaction is chromium with oxygen to form chromium oxide, equation 3. The fourth most likely reaction is iron with oxygen to form iron oxide, equation 4. The fifth most likely reaction is lead with oxygen to form lead oxide, equation 5. The sixth and least likely reaction is bismuth with oxygen to form bismuth oxide, equation 6. The most likely reactions in this system result in the oxidization of niobium, vanadium, chromium, and iron. The oxidation of lead and bismuth is the least thermodynamicly favorable. However, if the oxides of lead or bismuth form, they float in the molten metal cooling composition, resulting in heat transfer surface fouling or flow restrictions in the flow path. Therefore, if oxygen gas is introduced into a composition as defined above, bismuth and lead will oxidize last after niobium, vanadium, chromium, and iron.

FIG. 3 also shows the reaction of carbon with oxygen gas to produce carbon monoxide gas, as characterized by equation 7.

$$2C+O_2(g)=2CO(g) \quad (7)$$

When operating a system above approximately 300° C., the production of carbon monoxide gas occurs before the production of bismuth oxide or lead oxide. Additionally, if operated between approximately 300° C. and 700° C., niobium, vanadium, chromium, and iron will form oxides before the carbon reacts with oxygen to form carbon monoxide gas. As such, free carbon may be contained within the system as a safeguard against excessive amounts of oxygen being present therein. Thus, if all of the niobium, vanadium, chromium, and iron in a system have been oxidized, and excess oxygen is present, the excess oxygen will react with the carbon rather than lead or bismuth. The expectation is that enough carbon will be present to remove excess oxygen before bismuth oxide or lead oxide forms.

As earlier stated, a stable oxide surface layer mitigates the corrosion of metals. Therefore, it is advantageous to grow oxide layers on the respective surfaces of containment pipes, process systems, heat exchangers, valves, fittings, and other components of cooling systems when such surfaces are exposed to the molten metal cooling composition as described above. However, if oxidizing capacity is excessive (characterized by the generation of lead oxide and bismuth oxide in the molten metal cooling composition which would collect and float in a separator), a reduced flow rate of the molten metal cooling composition will occur due to an accumulation of oxides in the molten metal cooling composition (e.g. lead oxide). It has been reported that, in one Russian nuclear powered submarine, lead oxide accumulation reduced coolant circulation through the reactor core and reduced reactor power. The operator misinterpreted the plant response and withdrew the control rods. As a result of the operator's misinterpretation, the reactor reached melted-down stage due to increased temperature and reduced molten metal cooling composition flow.

With respect to the importance of maintaining the molten metal cooling composition in a substantially lead oxide-free state, a reduction process is provided for use as needed. In particular, the reduction of lead oxide occurs by introducing a reducing agent into the molten metal cooling composition when necessary. Typical reducing agents include carbon (optimally in solid particulate form), acetone, hydrogen, methane, ethane, propane, butane, pentane, octane, mixtures thereof, or equivalents thereto. The lead oxide reacts with the reducing agent to produce lead. This process is illustrated below in reaction equations 8, 9, and 10 employing, respectively, methane (reactions 8 and 9) and hydrogen (reaction 10) in representative and non-limiting embodiments.

$$CH_4(g)+2PbO=C+2H_2O(g)+2Pb \quad (8)$$

$$CH_4(g)+PbO=CO(g)+2H_2+Pb \quad (9)$$

$$H_2(g)+PbO=H_2O(g)+Pb \quad (10)$$

Figure 4:
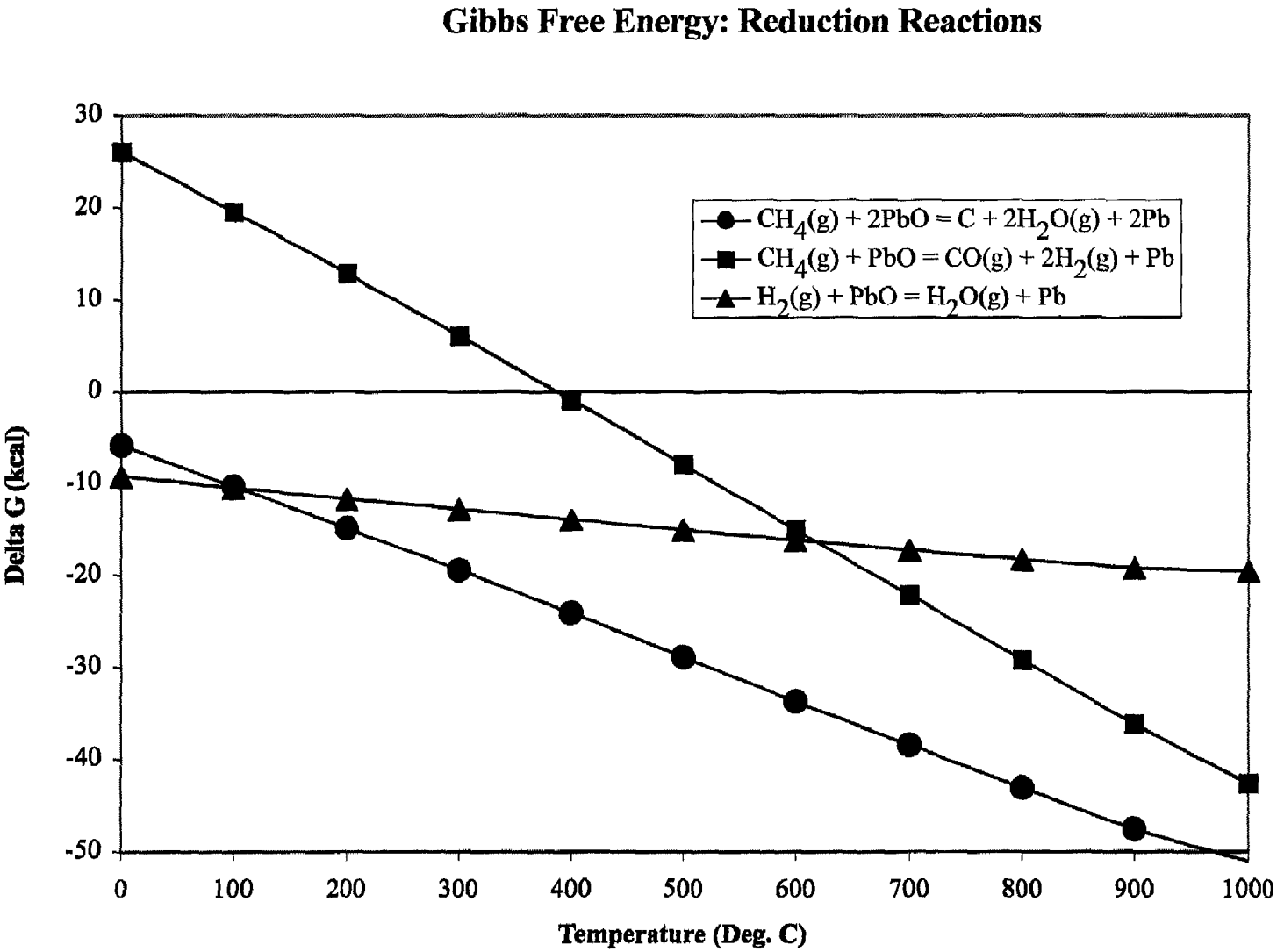
FIG. 4 is a chart of the free energy of formation of exemplary reduction reactions as a function of temperature.

Referring to FIG. 4, the reactions of methane and lead oxide (according to equation 8) and hydrogen and lead oxide (according to equation 10) can occur at any temperature above zero degrees Celsius, while the reduction reaction of methane and lead oxide as per equation 9 occurs above approximately 400° C. The byproducts of the reduction process of equation 9 involve carbon monoxide and water which are removed as a gas.

The processes set forth herein remain operative when the system operating temperature is above 700° C. or if the operation of the heat exchange sub-system requires the reduction of the stable oxide surface layer to increase heat transfer. In certain nuclear reactor designs, operating temperatures above 700° C. are desired for the generation of hydrogen from water via an auxiliary system. The carbon control system will still operate by preventing the formation of oxides, including but not limited to lead and bismuth oxides. However, operating temperatures above 700° C. will (see FIG. 3) reduce the oxide layer of the structures under consideration including those made of stainless steel. A slight reduction of the oxide layer will increase heat transfer into the molten metal. Furthermore, if the oxide layer on the structures being treated becomes too thick, it may dislodge resulting in corrosion as the oxide layer forms. Thus, the technology disclosed herein allows control of the oxide layer formation above 700° C.

Operation of the claimed apparatus and methods will now be described with reference to the foregoing reactions. In particular, during initial set up of the cooling system herein defined, an oxygenated molten metal cooling composition produces an oxide coating on the contact surface of the containment pipe 200. If the oxidation/reduction potential remains constant in the system, iron oxide will be present over the lead oxide. However, as per previous lead corrosion research, the oxide layer and thus the oxidation/reduction potential of the system change over time due to system impurities. As a result, the ability to grow or remove lead oxide is of importance. The tuyere tube 150 is connected to the shroud gas source 142 to permit shroud gas flow from the gas source 142 through the tuyere tube 150 for exit at the outlet portion 154. The shroud gas functions to homogeneously mix the molten metal cooling composition 176 with reaction agents present therein. This flow of shroud gas also helps to keep the outlet portion 154 of the tuyere tube 150 clear of molten metal cooling composition 176. The shroud (e.g. mixing) gas will be added (e.g. conveyed) to the system from the shroud gas source 142 using a conventional pump apparatus 240 or other known and equivalent delivery device as a suitable conveyance. Alternatively, the shroud gas source 142 itself with or without the hardware, conduits, etc. associated therewith may be considered an appropriate conveyance if suitably pressurized or otherwise configured to deliver the shroud gas to its desired destination. In this regard, the present invention shall not be restricted to any particular conveyance for delivery of the shroud gas as long as it is effectively transferred as discussed herein.

The oxidation/reduction tube 160 is configured to intermittently inject oxidizing or reducing agents as needed. The oxidizing agent is injected from the oxidizing agent source 168, and the reducing agent is injected from the reducing agent source 170. Both agents are controlled by the valve 166 and then travel through the oxidation/reduction tube 160 to the outlet 164. Ultimately, the agents mix with the molten metal cooling composition 176 to increase or decrease the amount of oxides in the system. Since the oxidizing and reducing agents are mixed with the shroud gas, the oxidizing and/or reducing agents are not able to react with the tuyere tube 150 or cause buildup on the tuyere tube outlet portion 154.

The method of growing the oxide layer on the containment pipe 200 will now be described. Specifically, the oxidizing agent from the oxidizing agent source 168 is intermittently added into the molten metal cooling composition 176 via the oxidation/reduction tube 160 to grow the oxide layer on the interior surface of the containment pipe 200. In the present representative example, oxygen is used as the oxidizing agent with the understanding that other oxidizing agents may be employed for this purpose as noted above. In a preferred and non-limiting exemplary embodiment which is generally applicable to all of the materials and systems discussed herein, the amount of oxidizing agent to be added will involve a concentration of oxygen between about 10–10,000 ppb (parts per billion). The oxidizing agent will be added (e.g. conveyed) to the cooling composition 176/interior of the containment pipe 200 from the oxidizing agent source 168 using a conventional pump apparatus 250 or other known and equivalent delivery device as a suitable conveyance. Alternatively, the oxidizing agent source 168 itself with or without the hardware, conduits, etc. associated therewith may be considered an appropriate conveyance if suitably pressurized or otherwise configured to deliver the oxidizing agent to its desired destination. In this regard, the present invention shall not be restricted to any particular conveyance for delivery of the oxidizing agent as long as it is effectively transferred as discussed herein. Assuming that the containment pipe 200 is composed of iron, chromium, and niobium in the present representative example, the oxygen will react with the pipe 200 to form an oxide layer. With reference to FIG. 3, if the system is operating at 500° C., the niobium will react with the oxygen to produce niobium oxide. After the niobium has substantially oxidized, the chromium will react with the oxygen to produce chromium oxide. After the chromium has substantially oxidized, the iron will react with the oxygen to produce iron oxide. In an idealized situation, the amount of oxygen present in the system would be equal to that required to form an oxide layer on the inside surface of the containment pipe 200. However, in reality, there will almost always be more oxygen than is required for producing the oxide layer on the inside of containment pipe 200. In order to compensate for this excessive amount of oxygen, a buffer such as, for example, carbon may used to avoid oxidizing lead or bismuth.

The carbon used as a buffer is present in the molten metal cooling composition 176 in a sufficient quantity to react with any excess oxygen. It is noted that, as used herein, the term "reducing agent" may include carbon. This carbon may be in a solid form or a constituent of one or more other materials. Excess oxygen is indicated when the inside surface of the containment pipe 200 is completely oxidized and oxygen is still in the molten metal cooling composition 176. The carbon can be introduced to the molten metal cooling composition 176 as a suspended particulate solid injected into the system via the tuyere tube 150, a solid sacrificial anode located in the system (not shown), or rods (not shown) that can be inserted into the molten metal cooling composition 176. Sources of carbon can include any carbonaceous matter including coal, graphite, propane, gasoline, acetone, benzene, mixtures thereof, or their equivalents. Regarding the amount of carbonaceous matter to be used for the purpose expressed above, a preferred and non-limiting representative embodiment will broadly involve a concentration of about 0.01–1.0 wt % (weight percent), with a preferred range of about 0.01–0.10 wt % (weight percent). If free carbon and oxygen are present in a system that is operated below approximately 650° C. then, by free energy of formation, the excess oxygen will be removed as carbon monoxide (created by reaction of the excess oxygen with the free carbon) rather than producing unwanted lead oxide or bismuth oxide.

Notwithstanding use of the carbon buffer discussed above, it is often inevitable that small amounts of lead and/or bismuth will react with oxygen to form lead oxide and bismuth oxide. Additionally, due to a local excursion in oxygen concentrations, lead oxide may increase and result in excess buildup of lead oxide and/or bismuth oxide. Lead oxide has a density which is approximately 80% that of lead; therefore, lead oxide will float to the top of molten lead. In one embodiment, the gas/liquid separation zone 180 may be located in the flow loop at a high spot, allowing for simplified removal of the lead oxide from the flow loop. The excess oxide that floats to the gas/liquid separation zone 180 may be detected by conventional optical or acoustical means. When the amount of lead oxide becomes excessive (which is generally defined to involve a situation where the surface of the molten metal is occluded from view by oxide floating on top), it can be removed by introducing a reducing agent into the tuyere tube 150 or into the gas zone 184 of the gas/liquid separator 180. Exemplary reducing agents suitable for this purpose include but are not limited to carbon, acetone, hydrogen, other hydrogen rich hydrocarbons (i.e. methane, ethane, propane, butane, pentane, and octane), mixtures thereof, or their equivalents. Because the lead oxide can be accumulated in one area, the potential for accumulation in the containment pipe 200 may be substantially eliminated. As such, the cooling system 100 is not as vulnerable to the accumulation of lead oxide in the flow path which could result in reduced flow of the cooling composition 176. Regarding the amount of reducing agent to be used for the purposes expressed above, a preferred and non-limiting embodiment will involve about 1–10 vol. % (volume percent) in an inert carrier gas. Reducing gas injection may be intermediate until the metal oxide is at least partially removed. The reducing agent will be added (e.g. conveyed) to the cooling composition 176/interior of the containment pipe 200 from the reducing agent source 170 using a conventional pump apparatus 260 or other known and equivalent delivery device as a suitable conveyance. Alternatively, the reducing agent source 170 itself with or without the hardware, conduits, etc. associated therewith may be considered an appropriate conveyance if suitably pressurized or otherwise configured to deliver the reducing agent to its desired destination. In this regard, the present invention shall not be restricted to any particular conveyance for delivery of the reducing agent as long as it is effectively transferred as discussed herein.

In one alternative embodiment, more than one tuyere tube 150 can be used. Additionally, more than one gas/liquid separation zone 180 can be employed. It is further noted that the reducing agents could be injected via a long annular diffusion pipe to accomplish better mixing and enhance the reactions. In another alternative embodiment, the cooling system 100 can be provided with a control system 300 (FIG. 2) for monitoring and adjusting system performance. The control system 300 (which is optimally equipped with a microprocessor) is connected to the gas analyzer system 192. Based on readings obtained by the gas analyzer system 192, the control system 300 calculates and determines the chemical characteristics of the molten metal cooling composition 176. If the molten metal cooling composition 176 requires reduction, the control system 300 directs the valve 166 to supply the reducing agent from the reducing agent source 170. If the molten metal cooling composition 176 requires oxidation, the control system 300 directs the valve 166 to supply the oxidizing agent from the oxidizing agent source 168. Additionally, the shroud gas source 142 can be controlled by the control system 300. In another alternative embodiment, a magnetic trap (not shown) is provided in the flow path. The magnetic trap collects any iron and/or iron oxide suspended in the molten metal cooling composition 176 which may be present because of peeling from the containment pipe 200.

In summary, the methods and systems set forth herein inhibit corrosion of structural materials containing liquid metal cooling compositions where such corrosion would otherwise occur. Impurities in the system are accommodated by increasing either oxidizing or reducing agents therein while making use of carbon as a buffer within the cooling composition to ensure that the system does not build up lead oxide. Furthermore, the oxidation/reduction potential can be verified by measuring the cover gas in the gas zone 184. In this manner, the system can be operated so that the containment pipes will not corrode and lead oxide will not build up in the system.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

I claim:

1. A method for cooling a heat source, said method comprising:

a) providing a cooling system in thermal association with said heat source, said cooling system comprising a closed-loop, thermally-conductive containment vessel with an oxidizable interior wall forming a hollow interior in which is housed a liquid metal cooling composition circulating through said interior, said containment vessel comprising a first portion positioned in thermal communication with said heat source for acceptance of heat, and a second portion positioned in thermal communication with a heat exchanger for dissipation of heat;

b) introducing an oxidizing agent into said cooling composition for oxidizing said interior wall of said containment vessel in order to form an oxide barrier layer on said interior wall so that said interior wall is protected from reaction with said cooling composition;

c) monitoring said cooling system in order to determine if an excess amount of said oxidizing agent is present; and d) introducing a reducing agent comprised of carbon in solid form into said cooling composition when said monitoring of said cooling system detects an excess amount of said oxidizing agent, said introducing of said reducing agent being done separately from said introducing of said oxidizing agent, with said introducing of said oxidizing agent and said introducing of said reducing agent occurring non-simultaneously.

2. A method for cooling a heat source, said method comprising:

a) providing a cooling system in thermal association with said heat source, said cooling system comprising a closed-loop, thermally-conductive containment vessel with an oxidizable interior wall forming a hollow interior in which is housed a liquid metal cooling composition circulating through said interior, said containment vessel comprising a first portion positioned in thermal communication with said heat source for acceptance of heat, and a second portion positioned in thermal communication with a heat exchanger for dissipation of heat;

b) introducing an oxidizing agent into said cooling composition for oxidizing said interior wall of said containment vessel in order to form an oxide barrier layer on said interior wall so that said interior wall is protected from reaction with said cooling composition;

c) introducing at least one inert mixing gas into said cooling composition in order to facilitate mixing of said oxidizing agent and said cooling composition within said cooling system;

d) monitoring said cooling system in order to determine if an excess amount of said oxidizing agent is present;

e) introducing a reducing agent comprised of carbon in solid form into said cooling composition when said monitoring of said cooling system detects an excess amount of said oxidizing agent; and f) magnetically attracting and removing from said cooling composition at least a portion of any solid, magnetically-attractable metallic contaminants which are present within said cooling composition.

* * * * *